US005634767A

United States Patent [19]

Dawson

[11] Patent Number: 5,634,767

[45] Date of Patent: Jun. 3, 1997

[54] TURBINE FRAME HAVING SPINDLE MOUNTED LINER

[75] Inventor: John Dawson, Boxford, Mass.

[73] Assignee: General Electric Company, Cincinnati, Ohio

[21] Appl. No.: 627,759

[22] Filed: Mar. 29, 1996

[51] Int. Cl.[6] ..... F01D 25/26

[52] U.S. Cl. ..... 415/134; 415/135; 415/209.3

[58] Field of Search ..... 415/134, 135, 415/136, 137, 138, 139, 209.3

[56] References Cited

U.S. PATENT DOCUMENTS

| | | | |
|---|---|---|---|
| 2,919,891 | 1/1960 | Oliver | 415/136 |
| 3,018,085 | 1/1962 | Welsh | 415/136 |
| 3,403,889 | 10/1968 | Ciokajlo | 415/138 |
| 5,224,825 | 7/1993 | Strang et al. | 415/135 |
| 5,357,744 | 10/1994 | Czachor et al. | 415/134 |
| 5,431,534 | 7/1995 | Charbonnel | 415/136 |

OTHER PUBLICATIONS

GE Aircraft Engines, "F404–GE–400, Turbine Exhaust Frame," in production greater than one year, Figure 1.

*Primary Examiner*—John T. Kwon
*Attorney, Agent, or Firm*—Andrew C. Hess; Wayne O. Traynham

[57] ABSTRACT

A turbine frame includes annular outer and inner bands with circumferentially spaced apart struts extending therebetween. Annular outer and inner liners adjoin the outer and inner bands, and a plurality of fairings surround respective ones of the struts and are joined to the liners. A plurality of circumferentially spaced apart telescopic outer and inner joints support the liners to the bands, and allow unrestrained differential thermal radial movement therebetween.

16 Claims, 5 Drawing Sheets

TURBINE FRAME HAVING SPINDLE MOUNTED LINER

The U.S. Government has rights in this invention in accordance with Contract No. N00019-92-C-0149 awarded by the Department of Navy.

BACKGROUND OF THE INVENTION

The present invention relates generally to gas turbine engines, and, more specifically, to turbine frames therein.

In a typical gas turbine engine, air is compressed in a compressor, mixed with fuel and ignited to produce combustion gases in a combustor, and channeled downstream through one or more stages of turbine nozzles and rotor blades. The blades extend radially outwardly from a disk which is joined to a shaft for powering the compressor or fan. The shaft is supported by bearings from a bearing support which forms part of a turbine frame.

An exemplary turbine frame disposed downstream of a last rotor stage, for example, includes a plurality of circumferentially spaced apart supporting struts which extend radially between outer and inner annular bands. The bearing support is fixedly joined to the inner band, and the outer band is fixedly joined to a structural casing of the engine.

Surrounding each of the struts is a hollow fairing which is suitably provided with pressurized cooling air bled from the compressor for cooling the turbine frame from the heating effects of the hot combustion gases which flow axially therethrough. The fairings are joined at their outer and inner ends to annular liners defining corresponding outer and inner flowpaths between which the combustion gases flow. During operation, the fairings are directly bathed in the combustion gases and therefore expand radially outwardly at a greater rate than the struts protected therein. The cooling air channeled through the fairings cools the fairings as well as the struts and further affects the differential thermal movement between the fairings and the struts.

In order to reduce thermally induced stress in the fairing assembly, it is mounted to float relative to the struts for obtaining unrestrained differential thermal expansion and contraction movement therebetween. Each fairing is suitably larger than the corresponding strut which it surrounds for receiving the cooling air for cooling these components during operation. In order to accurately axially and circumferentially position each fairing around its corresponding strut, axially spaced and independent supports or retainers are typically provided.

In one conventional design, mounting blocks having generally U-shaped recesses therein are mounted at various locations on the outer and inner liners so that the U-recess axially and circumferentially traps corresponding V-portions of the struts at their leading and trailing edges. For example, forward and aft U-blocks are mounted to the inner liner to trap the corresponding leading and trailing edges of the struts. Additional aft U-blocks are mounted to the outer liner to trap the trailing edges of the struts. And, a 360° ring is attached to the outer liner adjacent the leading edges of the several struts to axially abut the outer band.

In this way, the ring and several U-blocks attached to the fairing assembly abut respective portions of the struts and outer band to accurately position the fairing assembly relative to the struts. During operation, aerodynamic loads imposed upon the fairing by the combustion gases are carried through the respective blocks and retaining ring into the strut assembly. Differential thermal expansion and contraction between the fairings and the struts is permitted without restraint from the struts by the mounting blocks and retainer ring which are allowed to slide freely in the radial direction subject only to sliding friction.

The multi-block and retainer ring configuration described above requires correspondingly configured parts for each location which increases the number of parts required therefor, with each of these parts typically having a different configuration for its different location relative to the struts. Furthermore, the several mounting blocks and retainer ring carry aerodynamic reaction forces caused by the aerodynamic force generated by the combustion gases on the fairings during operation, with the reaction forces necessarily being distributed among the mounting blocks and retainer rings. The distributed reaction loads correspondingly cause wear, and effect reaction moments or couples which increase the complexity of the structural design for accommodating the resulting stress within acceptable limits.

SUMMARY OF THE INVENTION

A turbine frame includes annular outer and inner bands with circumferentially spaced apart struts extending therebetween. Annular outer and inner liners adjoin the outer and inner bands, and a plurality of fairings surround respective ones of the struts and are joined to the liners. A plurality of circumferentially spaced apart telescopic outer and inner joints support the liners to the bands, and allow unrestrained differential thermal radial movement therebetween.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
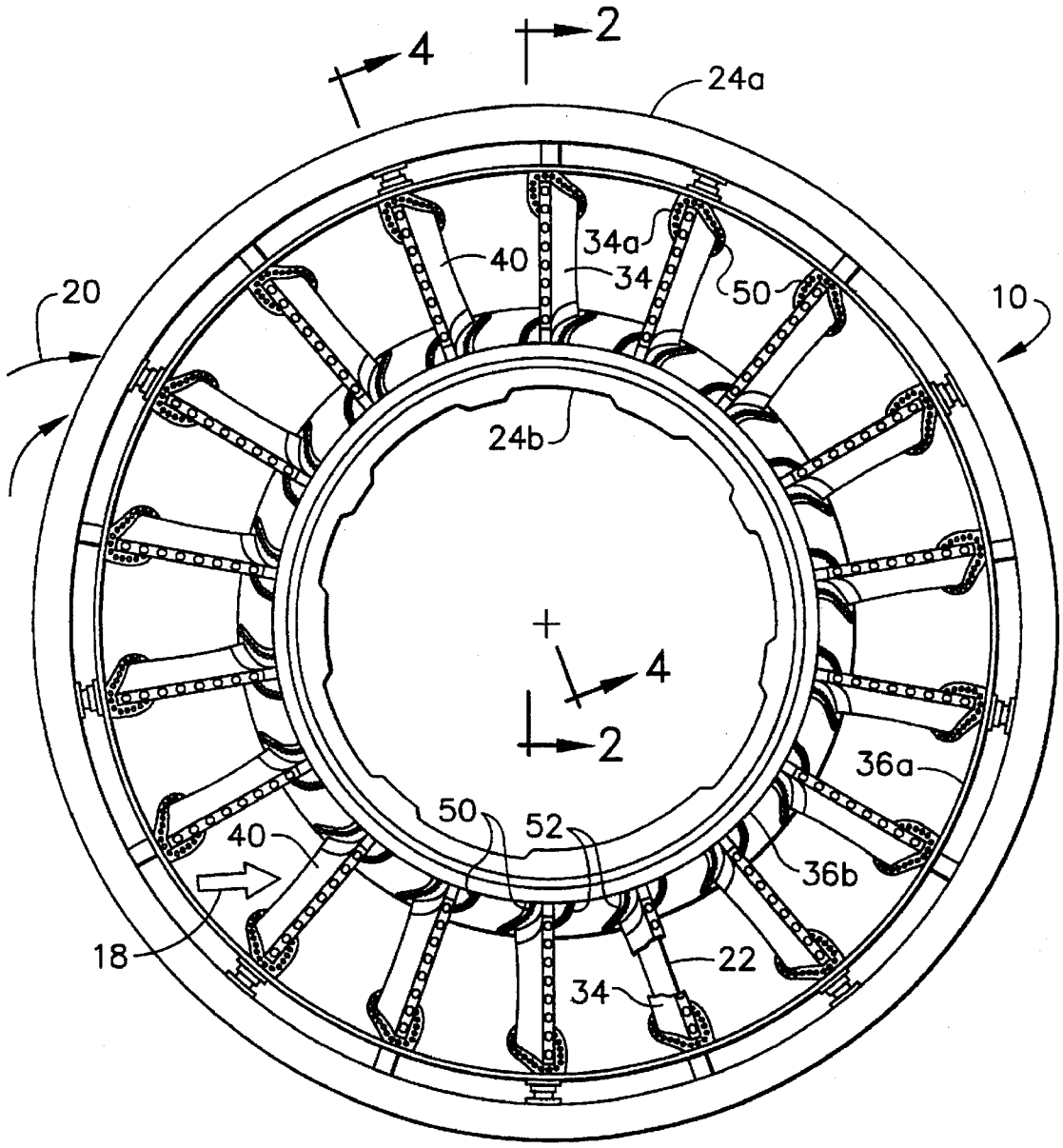
FIG. 1 is a radial elevational, aft-facing-forward view of an exemplary gas turbine engine turbine frame having liner mounted fairings surrounding corresponding band mounted struts, with the liners being mounted to the bands at telescopic joints in accordance with an exemplary embodiment of the present invention.
Figure 2:
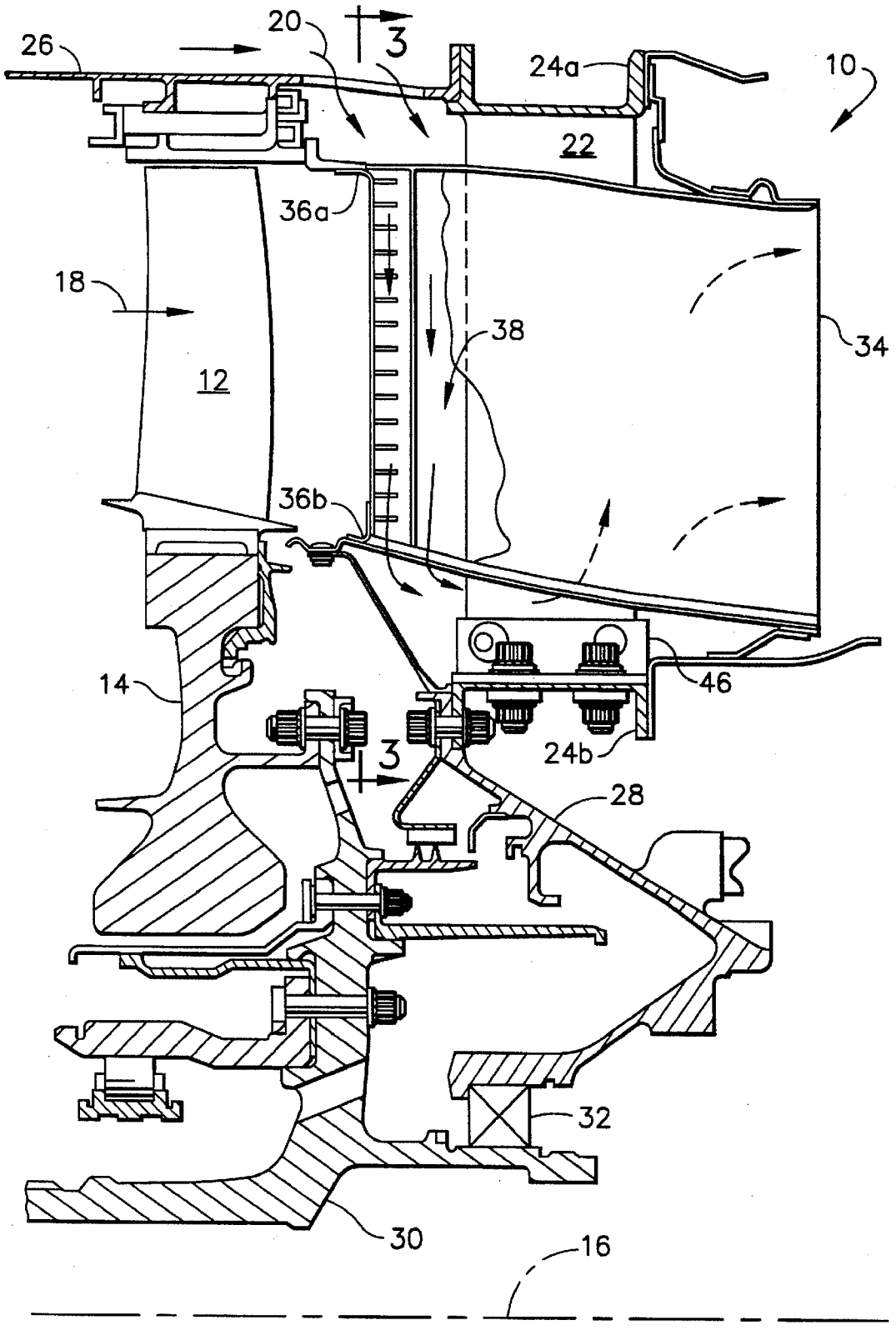
FIG. 2 is an elevational, partly sectional axial view of the turbine frame shown in FIG. 1 and taken along line 2—2 illustrating one of the fairings surrounding a corresponding one of the struts.

Illustrated in FIGS. 1 and 2 is a turbine frame 10 of an exemplary aircraft turbofan gas turbine engine having a row of last stage rotor blades 12 joined to a rotor disk 14. The frame 10 and disk 14 are disposed coaxially about a longitudinal or axial centerline axis 16 of the engine, and receive in turn hot combustion gases 18 which are formed in a combustor thereof (not shown). A compressor (not shown) of the engine pressurizes air which is mixed with fuel and ignited in the combustor for generating the combustion gases 18. A portion of the pressurized air is conventionally bled from the compressor and channeled through the frame 10 as pressurized cooling air 20 which is used for cooling the turbine frame 10 in a conventional manner against the heating effects of the combustion gases 18.

The turbine frame 10 includes a plurality of circumferentially spaced apart and radially extending support struts 22. The struts are suitably fixedly joined to a radially outer ring or band 24*a*, and to a radially inner hub or band 24*b*. The outer band 24*a* is fixedly joined to an annular casing 26 of the engine. The inner band 24*b* is fixedly joined to a suitable annular bearing support 28 which is in the exemplary form of two conical members. A rotor shaft 30 is suitably joined to the disk 14 and is mounted to the bearing support 28 by a conventional bearing 32. The struts 22 and bearing support 28 provide a relatively rigid assembly for carrying rotor loads to the casing 26 during operation of the engine.

Surrounding each of the struts 22 is a suitable fairing 34 over which the combustion gases 18 flow during operation, and within which the cooling air 20 is suitably channeled for cooling the struts 22 and fairings 34. The fairings 34 are fixedly joined at radially outer and inner ends thereof to corresponding annular outer and inner liners 36*a,b*. The liners 36*a,b* are annular members which confine the flow of the combustion gases 18 therebetween, and are therefore correspondingly heated as the combustion gases 18 flow thereover. The fairings and liners are supported by the bands 24*a,b* for unrestrained differential thermal movement therewith in accordance with the present invention as described hereinbelow.

As shown in FIG. 2, the cooling air 20 is suitably channeled to the turbine frame 10 and passes through a suitable cooling circuit 38 therein which passes in part radially inwardly through the individual fairings 34 and through corresponding apertures in the inner liner 36*b* for channeling the cooling air 20 adjacent to the inner band 24*b*. Suitable seals are provided for confining the cooling air 20 so that the liners and bands are suitably cooled during operation. The spent cooling air is discharged from the several fairings 34 through conventional apertures along the trailing edges thereof.

In the exemplary embodiment illustrated in FIG. 1, the turbine frame 10 further includes a plurality of vanes 40 fixedly joined to the outer and inner liners 36*a,b*, with each vane 40 being disposed circumferentially between adjacent ones of the fairings 34. In the exemplary FIG. 1 embodiment, there are nine fairings 34 and struts 22 therein uniformly spaced apart around the perimeter of the frame 10, with nine vanes 40 disposed between respective ones of the fairings 34. The vanes 40 are substantially identical in configuration to the fairings 34, except that no strut 22 extends radially therethrough. The fairings 34 and vanes 40 are conventionally used to suitably direct the combustion gases 18 in the downstream direction, and in the exemplary embodiment are crescent shaped for also turning the flow in the circumferential direction. In alternate embodiments, the vanes 40 may be eliminated.

Figure 3:
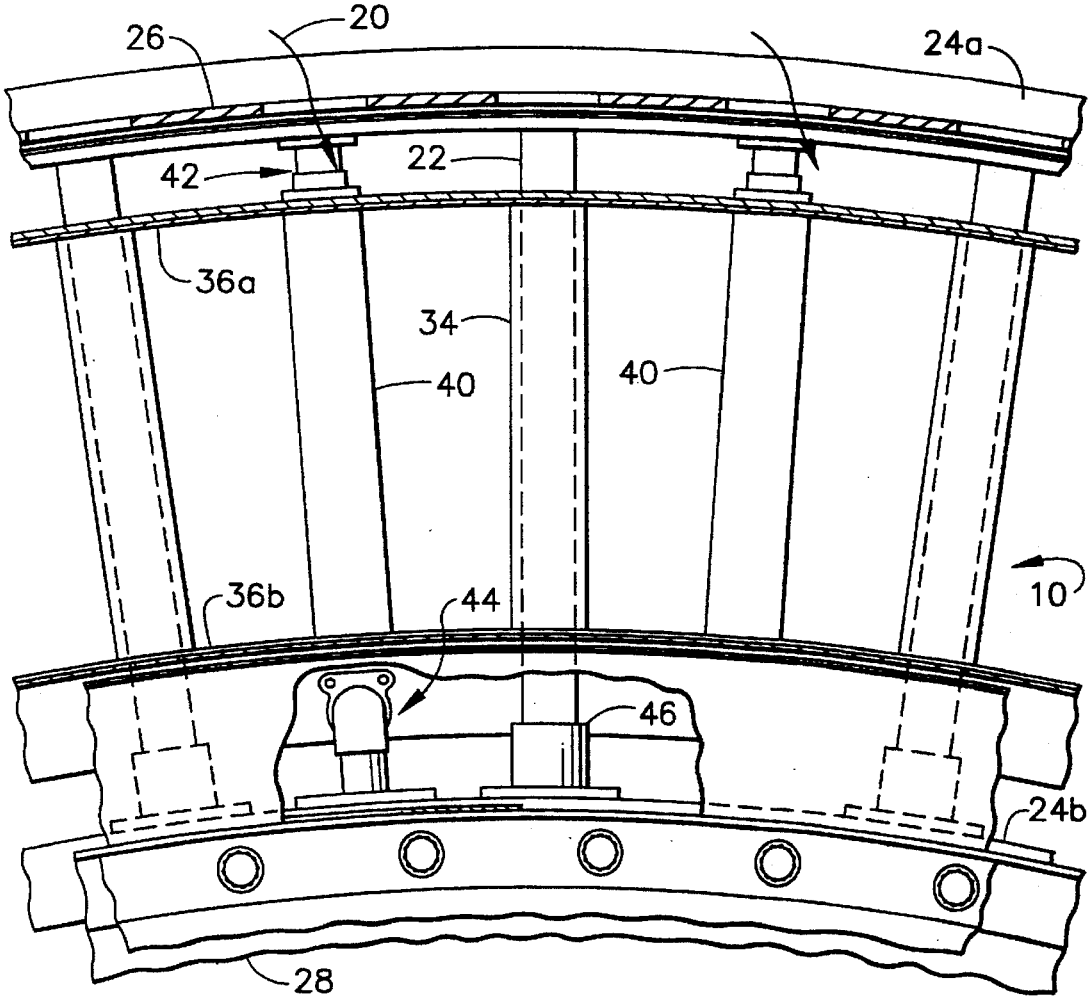
FIG. 3 is a radial elevation, forward-looking-aft view of a portion of the turbine frame shown in FIG. 2 and taken generally along line 3—3 illustrating adjacent fairings and liner mounted vanes disposed circumferentially therebetween.

As shown in FIG. 3, the outer liner 36*a* is spaced radially inwardly from the outer band 24*a*, and the inner liner 36*b* is spaced radially outwardly from the inner band 24*b*. In order to accurately support the fairing assembly between the outer and inner bands, a plurality of circumferentially spaced apart telescopic outer joints 42 extend radially between the outer liner 36*a* and the outer band 24*a*. And, a plurality of circumferentially spaced apart telescopic inner joints 44 extend radially between the inner liner 36*b* and the inner band 24*b*. The outer and inner joints 42, 44 are telescopic in the radial direction for supporting the outer and inner liners 36*a,b*, and the fairings 34 and vanes 40 therebetween, to the outer and inner bands 24*a,b* to allow unrestrained differential thermal radial movement therebetween. The joints allow the liners to float or thermally expand and contract in the radial direction without restraint from the bands 24*a,b* and struts 22 to prevent thermally induced reaction loads in the liner assembly. However, the joints 42, 44 axially and circumferentially retain the liners to prevent undesirable movement thereof in these directions during operation.

Figure 4:
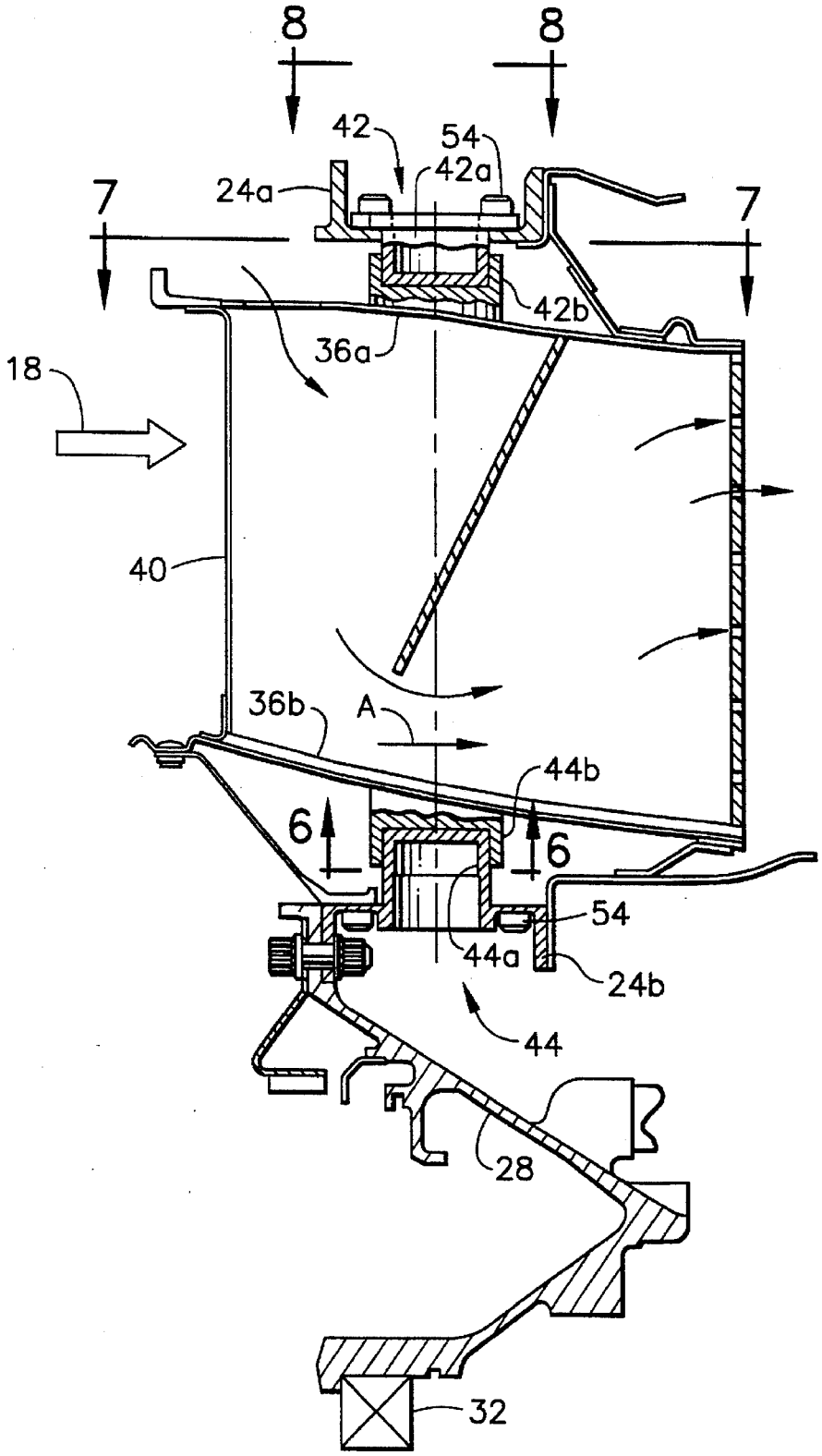
FIG. 4 is an elevational, partly sectional axial view of the turbine frame shown in FIG. 1 and taken generally along line 4—4 illustrating one of the vanes therein and corresponding outer and inner telescopic joints mounting the liners to the bands in accordance with an exemplary embodiment of the present invention.

The outer and inner joints 42, 44 are preferably disposed in radially aligned pairs as illustrated in FIG. 4 in an exemplary embodiment. Although the joints 42, 44 may be positioned at any circumferential location between adjacent ones of the struts 22, it is preferred that they be positioned adjacent to respective ones of the vanes 40 for being readily assembled therewith as described in more detail below.

Figure 5:
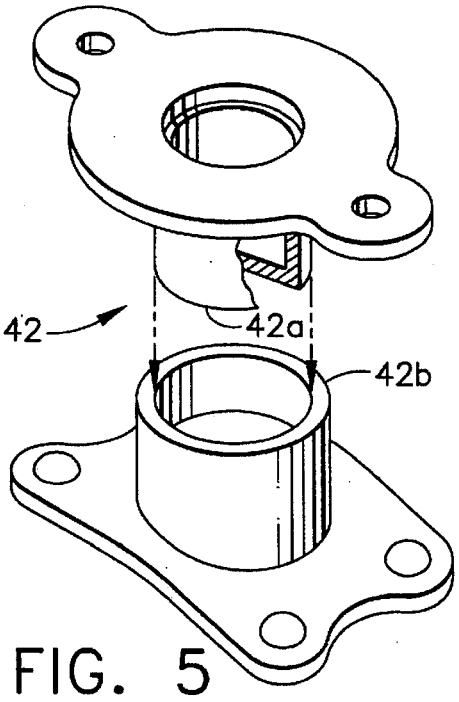
FIG. 5 is an exploded, isometric view of an exemplary one of the outer joints illustrated in FIG. 4.

FIG. 4 illustrates an exemplary pair of the radially aligned outer and inner joints 42, 44, with an exploded view of an exemplary one of the outer joints 42 being illustrated in FIG. 5. The inner joints 44 are similar in configuration to the outer joints 42 illustrated in FIG. 5, except that they are specifically configured for being mounted between the inner liner 36*b* and the inner band 24*b*, and may be further tailored in configuration as described hereinbelow. Each of the outer and inner joints 42, 44 comprises a spindle 42*a*, 44*a*, respectively, which sliding engages a complementary socket 42*b* and 44*b*, respectively, for allowing differential extension and contraction movement therebetween along the common radial axis extending therethrough.

As shown in FIG. 4, the respective outer and inner spindles 42*a*, 44*a* are suitably fixedly joined to the outer and inner bands 24*a,b* , respectively, and extend radially toward the outer and inner liners 36*a,b*. The outer and inner sockets 42*b*, 44*b* are suitably fixedly joined to the outer and inner liners 36*a,b*, respectively, and extend radially toward the outer and inner bands 24*a,b* for engaging respective ones of the spindles 42*a*, 44*a*. As shown in FIGS. 4 and 5, the outer and inner spindles 42*a*, 44*a*, are preferably cylindrical, and extend in part into respective ones of the outer and inner sockets 42*b*, 44*b* for restraining differential circumferential movement between the liners 36*a,b* and the bands 24*a,b*, while allowing differential radial movement therebetween.

As shown in FIG. 5, the outer sockets 42*b* are preferably cylindrical and complementary to the outer spindles 42*a* for allowing a suitable amount of sliding movement therebetween, which is in the radial direction as illustrated in FIG. 4. The outer spindles 42*a* engage the outer sockets 42*b* with a suitably small clearance or gap therebetween, and thereby restrain or limit lateral movement between the outer spindles 42*a* and sockets 42*b*, which correspondingly restrains and limits movement of the outer liner 36*a* in both forward and aft axial directions in the annular turbine frame 10, as well as restrains and limits circumferential movement in opposite directions.

The inner spindles 44a and cooperating sockets 44b are similarly configured for allowing a suitable amount of radial movement between the inner liner 36b and the inner band 24b by vertical movement of the spindles in the sockets while restraining or limiting axial and circumferential movement between the inner liner 36b and the inner band 24b. However, since the liners 36a,b, fairings 34, and vanes 40 are joined together in a complex three dimensional annular assembly, they are subject to thermal gradients therethrough which can cause differential thermal movement between the various portions thereof.

More specifically, the combustion gases 18 which flow over the fairings 34 and vanes 40 during operation as illustrated in FIG. 4 heat the leading edges thereof to higher temperatures than the trailing edges thereof. As a result, the inner liner 36b is caused to move in the aft direction indicated by the arrow labeled A, which, if constrained, would generate undesirable thermal reaction loads in the liner assembly. Accordingly, the inner sockets 44b, as illustrated in more particularity in FIG. 6, are preferably oblong in configuration for allowing a suitable and preselected amount of differential axial movement between the inner liner 36b and the inner band 24b due to the thermal gradients in the liners 36a,b, fairings 34, and vanes 40.

Figure 6:
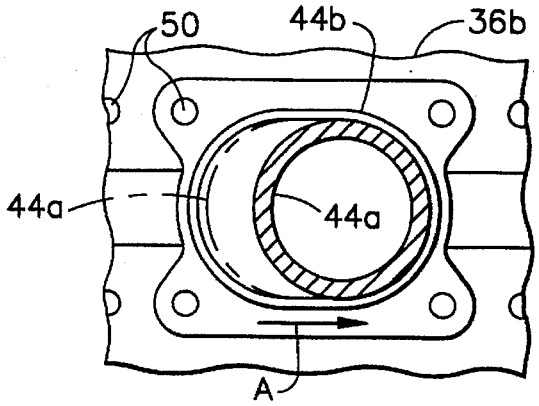
FIG. 6 is a top, radially outwardly facing view of an exemplary one of the inner sockets of the inner telescopic joint illustrated in FIG. 4 and taken generally along line 6—6.

As shown in FIG. 6, each of the inner sockets 44b has semicircular, axially forward and aft ends with flat sides extending therebetween in an elongated circular configuration, with the flat sides being about 50 mils long, for example. The flat sides of the inner sockets 44b extend generally in the axial direction of the turbine frame 10 so that the sockets 44b are allowed to travel without axial restraint in the aft direction relative to the corresponding inner spindles 44a as the liner assembly is heated during operation. Upon heating to operating temperature, the inner spindles 44a are located at the opposite sides of the inner sockets 44b, as illustrated in phantom in FIG. 6, with the axial travel therein preventing undesirable reaction loads between the components which would otherwise occur if the inner sockets 44b were not allowed to move axially without restraint relative to the inner spindles 44a.

Figure 7:
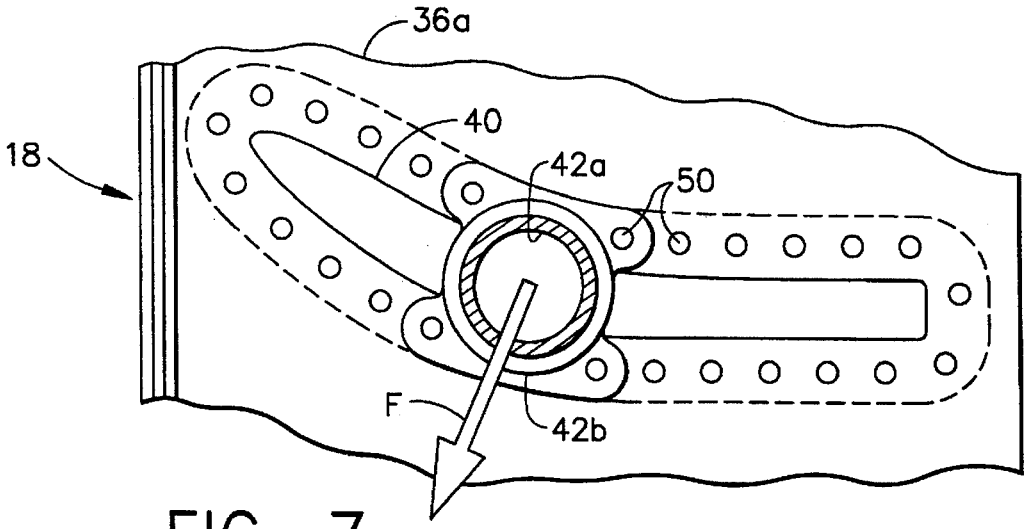
FIG. 7 is a top view of the outer liner illustrated in FIG. 4 and taken generally along line 7—7 illustrating a socket of the outer joint which cooperates with the outer spindle.

As shown in FIG. 3, the outer and inner joints 42, 44 are preferably spaced equidistantly between adjacent ones of the struts 22, and preferably radially aligned with each other and with corresponding ones of the vanes 40. As shown in FIGS. 4 and 7, each of the vanes 40 has a radially extending axis which defines a centerline of resultant aerodynamic force due to the combustion gases 18 which flow over the vanes 40. Since the vanes 40 are aerodynamically configured for turning the combustion gases 18, they develop aerodynamic reaction forces thereon, with the resultant aerodynamic force being labeled F. The pairs of outer and inner joints 42, 44 are preferably radially aligned with each corresponding vane 40 along the resultant aerodynamic force centerline thereof, so that the aerodynamic reaction forces are carried through each of the outer and inner joints 42, 44 generally through the centerlines thereof. In this way, reaction moments or couples laterally along the centerlines are eliminated or reduced. The corresponding sockets 42b, 44b of the outer and inner joints 42, 44 are thereby preferably disposed radially atop each of the opposite ends of the vanes 40, with the vanes 40 providing a radially rigid interconnection between respective ones of the outer and inner sockets 42b, 44b.

The turbine frame 10, including the outer and inner joints 42, 44, may be suitably configured and assembled in various manners. In the exemplary embodiment illustrated in FIGS. 2 and 3, the outer band 24a and the struts 22 are preferably made as a common one-piece casting. The inner band 24b is a separate casting which is suitably fixedly joined to the several struts 22 by suitable clevises 46 which are bolted to the inner band 24b and suitably pinned to respective ones of the struts 22.

The outer liner 36a illustrated in FIGS. 2 and 3 may be fabricated as a ring with suitable axial end-slots for allowing the outer liner 36a to be axially assembled around each of the struts 22. A suitable end band may then be fixedly joined to the outer liner 36a to cover the exposed portions of the end slots. The individual fairings 34 followed in turn by the inner liner 36b may be installed radially upwardly over the respective struts 22 prior to assembly of the inner band 24b. The inner liner 36b is preferably formed of several overlapping arcuate segments which are suitably riveted together.

As shown in FIG. 1, each of the fairings 34 may have an integral outer flange 34a which is suitably attached to the outer liner 36a by rivets 50. The radially inner ends of the fairings 34 may be suitably mounted in shoes 52 specifically configured therefor, with each shoe 52 having a suitable flange fixedly joined to the inner liner 36b by more of the rivets 50. The vanes 40 may be inserted between adjacent ones of the struts 22 and attached to the outer and inner liners 36a,b in any suitable manner, including riveting integral outer flanges and inner shoes like done for the fairings 34.

Figure 8:
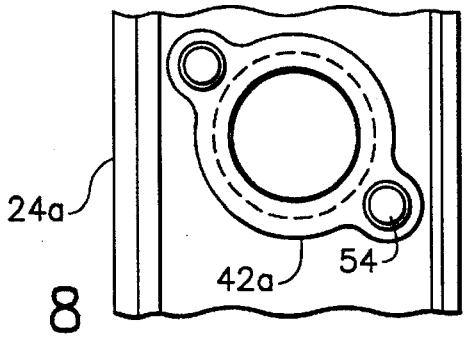
FIG. 8 is a top view of one of the outer joints illustrated in FIG. 4 including an outer spindle mounted to the outer band.

As shown in FIG. 7, the outer sockets 42b, and similarly the inner sockets 44b, have integral mounting flanges which may be fixedly joined to the respective outer and inner liners 36a,b using some of the same rivets 50 used for mounting the vanes 40 to the liners. The individual outer and inner spindles 32a, 44a may be suitably fixedly mounted to the respective outer and inner bands 24a,b . For example, fastening bolts 54 may be used, as shown in FIGS. 4 and 8, to bolt the outer and inner spindles 42a, 44a to the respective outer and inner bands 24a,b to engage their respective outer and inner sockets 42b, 44b, which also allow the spindles to be individually removable for replacement if desired.

More specifically, each of the spindles 42a, 44a is preferably formed of a material having suitable wear resistance, or coated with a suitable wear resistant coating. The corresponding sockets 42b, 44b are preferably harder in material composition than that of the spindles so that friction wear over time occurs primarily in the spindles 42a, 44a, which may therefore be replaced as required. In one exemplary embodiment, the outer and inner spindles 42a, 44a may be formed of L605, also known as Haynes alloy 25, which is a cobalt based alloy, commercially available from Haynes International, Inc., located in the Kokomo, Ind. In an alternate embodiment, the spindles could be any suitable metal with a suitable wear-resistant coating thereon such as T800, which is a tungsten carbide and cobalt material, thermally deposited, and commercially available from the Nuclear Metals company, located in Concord, N.H. The preferably harder outer and inner sockets 42b, 44b, may be formed of Rene 41, which is a nickel based alloy casting, commercially available from Precision Cast Parts Corp., located in Portland, Oreg.

Any suitable number of outer and inner joints 42, 44 may be used for mounting the liner assembly to the corresponding bands 24a,b for allowing unrestrained differential radial expansion and contraction therebetween. The relatively simple spindle-and-socket joints 42, 44 provide basically single location mounting which reduces or eliminates reaction bending moments or couples due to the aerodynamic gas loads. The spindles provide support in all directions perpendicular to their own centerline axes, and thusly eliminate the need for separate axial and radial support. The joints provide positive retention of the liners to the bands and effectively eliminate assembly stack-up clearances or gaps. The close fitting spindle and socket joints have a simple and accurate fit-up which reduces wear during operation caused by vibratory movements of the various components of the turbine frame 10.

Since the joints 42, 44 are all located in the same thermal environment between the respective liners and bands, they operate at generally the same temperature resulting in no local relative thermal growth therebetween. And, the spindles 42*a*, 44*a* are easily replaceable as required during the life of the frame 10, with the corresponding sockets 42*b*, 44*b* being also replaceable if required.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims.

I claim:

1. A turbine frame comprising:

an annular outer band;

an annular inner band spaced radially inwardly from said outer band;

a plurality of circumferentially spaced apart struts fixedly joined to said outer and inner bands;

an annular outer flowpath liner spaced radially inwardly from said outer band;

an annular inner flowpath liner spaced radially outwardly from said inner band;

a plurality of fairings surrounding respective ones of said struts and fixedly joined to said outer and inner liners;

a plurality of circumferentially spaced apart telescopic outer joints extending radially between said outer liner and outer band;

a plurality of circumferentially spaced apart telescopic inner joints extending radially between said inner liner and inner band; and wherein said outer and inner joints support said outer and inner liners and said fairings therebetween to said outer and inner bands, and allow unrestrained radial movement therebetween.

2. A frame according to claim 1 wherein each of said outer and inner joints comprises a spindle slidingly engaging a complementary socket for allowing differential extension and contraction movement therebetween.

3. A frame according to claim 2 wherein said outer and inner joints are disposed circumferentially between adjacent ones of said struts.

4. A frame according to claim 3 wherein said outer and inner joints are disposed in radially aligned pairs.

5. A frame according to claim 4 wherein:

said spindles of said outer and inner joints are fixedly joined to said outer and inner bands, respectively, and extend radially toward said liners; and said sockets of said outer and inner joints are fixedly joined to said outer and inner liners, respectively, and extend radially toward said bands.

6. A frame according to claim 5 wherein said spindles are cylindrical, and extend in part into respective ones of said sockets for restraining differential circumferential movement between said liners and bands while allowing differential radial movement therebetween.

7. A frame according to claim 1 wherein each of said fairings is separately joined to said outer liner, and is joined to said inner liner in shoes therefor.

8. A frame according to claim 6 wherein said sockets of said outer joints are cylindrical and complementary to said spindles of said outer joints.

9. A frame according to claim 6 wherein said sockets of said inner joints are oblong for allowing differential axial movement between said inner liner and said inner band due to thermal gradients in said outer and inner liners and fairings.

10. A frame according to claim 6 further comprising a plurality of vanes fixedly joined to said outer and inner liners, with each vane being disposed circumferentially between respective ones of said fairings, and wherein said sockets of said outer and inner joints are disposed atop said vanes.

11. A frame according to claim 10 wherein said outer and inner joint pairs are each radially aligned with a corresponding vane along a resultant aerodynamic force centerline thereof.

12. A frame according to claim 10 wherein said vanes, outer joints, and inner joints are disposed circumferentially between respective ones of said struts.

13. A frame according to claim 1 further comprising:

an annular casing fixedly joined to said outer band;

an annular bearing support fixedly joined to said inner band; and a bearing disposed on said bearing support.

14. A frame according to claim 1 further comprising means for channeling cooling air between each of said fairings and said struts.

15. A frame according to claim 5 wherein said spindles of said outer and inner joints are removably joined to said outer and inner bands using fasteners for effecting individual replacement thereof.

16. A frame according to claim 1 wherein said outer band and struts comprise a common one-piece assembly, and said inner band is fixedly joined to said struts at respective clevises.

* * * * *